United States Patent [19]

Murase

[11] Patent Number: 4,463,868

[45] Date of Patent: Aug. 7, 1984

[54] MOUNTING STRUCTURE FOR MOUNTING NOZZLE BODY OF SPECIAL MATERIAL

[75] Inventor: Noriyoshi Murase, Akashi, Japan

[73] Assignee: Kabushiki Kaisha Kobe Seiko Sho, Kobe, Japan

[21] Appl. No.: 523,436

[22] Filed: Aug. 16, 1983

[30] Foreign Application Priority Data

Aug. 16, 1982 [JP] Japan ..... 57-123906[U]

[51] Int. Cl.[3] ..... B65D 41/04

[52] U.S. Cl. ..... 220/288; 285/201

[58] Field of Search ..... 220/288; 222/568, 566; 285/201

[56] References Cited

U.S. PATENT DOCUMENTS 3,124,267 3/1964 Cetrone ..... 220/288

4,179,038 12/1979 Rosan, Jr. ..... 220/288

4,231,488 11/1980 Ward et al. ..... 220/288

*Primary Examiner*—George T. Hall

*Attorney, Agent, or Firm*—Oblon, Fisher, Spivak, McClelland & Maier

[57] ABSTRACT

The disclosure is directed to a structure for mounting a cylindrical nozzle body on a pressure vessel body having an internal lining for corrosion resistance or other purposes, said nozzle body being of a material which cannot be welded to the pressure vessel body. The nozzle body is provided with a flange of recessed portion at its leading end directed into the pressure vessel, a stepped portion for abutment against a seating surface of the pressure vessel body at its periphery behind the recessed portion and a threaded portion for securing the nozzle body to the vessel at a periphery thereof rearwardly of the recessed portion.

5 Claims, 8 Drawing Figures

MOUNTING STRUCTURE FOR MOUNTING NOZZLE BODY OF SPECIAL MATERIAL

BACKGROUND OF THE INVENTION

This invention relates to a mounting structure for mounting a nozzle on a pressure vessel, and more particularly it relates to a structure for mounting a cylindrical nozzle body on a pressure vessel body having an internal lining for corrosion resistance or other purposes, said nozzle body being made of a material which cannot be welded to the pressure vessel body.

In the case where a pressure vessel has a lining of such a nonferrous metal material incapable of being welded to a steel vessel, for example titanium, an inner surface of the nozzle to be mounted on the pressure vessel should be made of a corrosion-resistant material or the like.

A conventional nozzle mounting structure for the this purpose, as shown in FIG. 1, is formed by welding, to a pressure vessel body 1, a nozzle body 2 of the same material as the vessel body as designated 3, covering an inner surface of the nozzle body 2 with a liner 4 of a special material and welding the liner 4 to a liner 5 adhered to an inner surface of the pressure vessel body side 1 as designated 6. Because of the difference in coefficient of thermal expansion between the liner 4 on the nozzle side and the nozzle body 2, a crack 7 can occur at a welding joint portion 6 between the nozzle side liner 4 and the body side liner 5 or the body side liner 5 can rise to form a clearance gap 8 with respect to the vessel body as seen in FIG. 2 through of repeated transition between a high temperature state existing during operation and a low temperature state existing during shutdown. This results not only in corrosion and other unfavorable phenomena but also in a need for periodic replacement of the nozzle side liner 4 since a corrosive fluid flows inside the nozzle side liner 4 and its leading edge portion 9 is worn out quickly due to erosion and corrosion.

The above structure wherein the welding portion 6 is given sufficient strength is also disadvantageous in that replacing only the nozzle side liner is very difficult, a gasket seat 11 is necessary at a joint portion 10 with an opposing flange of the nozzle body, and the liner 4 is thus complex in structure, resulting in an increase in manufacturing cost, difficulty in assembling procedure, etc.

SUMMARY OF THE INVENTION

Accordingly, it is an object of the present invention to provide a mounting structure for mounting a nozzle of special material on a pressure vessel which includes a nozzle body integrally formed of a material incapable of being welded to the pressure vessel body instead of a nozzle structure having an inner lining of a special material, and a threaded structure for securing the nozzle on the vessel body side. The major feature of the mounting structure for mounting the nozzle of such special material on the pressure vessel lies in that the nozzle body is provided with a recessed portion at its leading end directed into the pressure vessel, a stepped portion for abutment against a seating surface of the pressure vessel body at its periphery behind the recessed portion and a threaded portion for securing the nozzle body to the vessel at a periphery thereof rearwardly of the recessed portion.

BRIEF DESCRIPTION OF THE DRAWINGS

The foregoing and other objects, features and advantages of the present invention will be better understood from the following description with reference to the accompanying drawings.

DETAILED DESCRIPTION OF THE INVENTION

Figure 1:
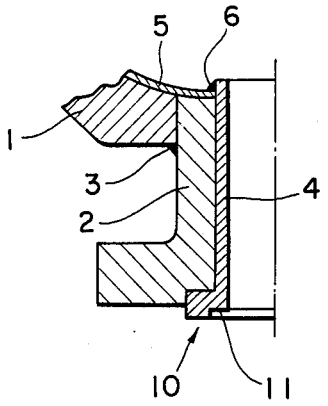
FIG. 1 PRIOR ART
FIGS. 1 and 2 are cross sectional side views of conventional mounting structures for mounting a nozzle on a pressure vessel
Figure 2:
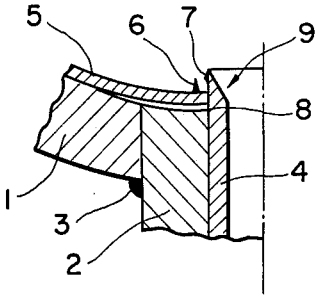
FIG. 2 PRIOR ART
Figure 3:
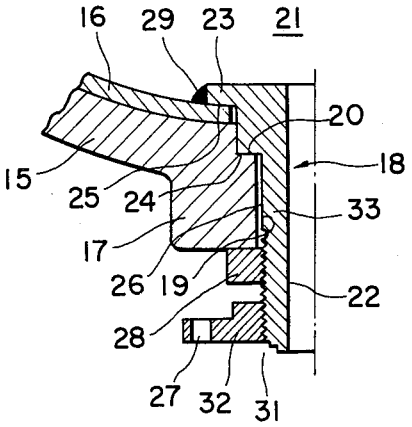
FIG. 3 is a cross sectional side view of a nozzle mounting structure according to a first embodiment of the present invention.

In FIG. 3 illustrating the first embodiment, a steel pressure vessel body 15 has an inner liner 16 which is made of corrosion-resistant material such as titanium and zirconium and applied thereby by adhering. The pressure vessel body 15 is provided at its boss portion 17 with an installation hole 19 for a nozzle body 18 made of a special material such as titanium and zirconium to be inserted therein. The installation hole 19 is open to a chamber 21 in the vessel body 18 and has a horizontal seating portion 20. The nozzle body 18 is provided with a nozzle opening 22 for passage of a corrosive fluid or the like at its central portion, an integral collar portion 23 in the shape of a flange at its leading end and a stepped portion 24 in a horizontal direction for abutment against the seating portion 20 behind the collar portion 23. The collar portion 23 is further provided at its rear surface with a recessed portion 25 which abuts on a surface of the liner 16 on the pressure vessel body side in a mounting state as seen in FIG. 3. It is noted that the outer diameter of an outer peripheral portion 26 of a bulge portion 33 of the nozzle body extending rearwardly of the stepped portion 24 is slightly smaller than the inner diameter of the installation hole 19. There is provided a threaded portion 27 at an outer peripheral portion of a trailing end of the bulge portion 33 extending from the pressure vessel portion so that the nozzle body 18 may be secured to the pressure vessel body 15 while fastening the liner 16 and the boss portion 17 of the pressure vessel body for one another, by compression between a nut 28 threaded into the threaded portion 27 and the collar portion 23 of the nozzle body 18. Seal welding 29 is then effected on a joint between the collar portion 23 of the nozzle body 18 and the liner 16. The nozzle body 18 is further provided at its rear end portion 30 with a gasket seat 31 adjacent which a flange 32 is threaded for connection with an opposing flange.

To mount the above described nozzle body on the pressure vessel body, the bulge portion 33 of the nozzle body 18 is inserted into the installation hole 19 of the pressure vessel body from inside to outside of the vessel.

After the stepped portion 24 of the nozzle body is positioned to abut against the seating portion 20, the nut 28 in threading relationship with the threaded portion 27 is tightened up to secure the nozzle body to the pressure vessel body. Finally, the collar portion 23 is welded to the liner 16. Preferably, the flange 32 may be threaded into the threaded portion 27 when being connected to a line or piping.

In the first embodiment wherein the nozzle body is secured to the pressure vessel body by means of the tightening force of the nut 28, there is a possibility that repeated expansion and contraction of the nozzle body caused by the difference in coefficient of thermal expansion between the pressure vessel body and the nozzle body due to operation and shutdown can reduce the tightening force of the nut 28 and adversely affect the seal welding portion 29.

Figure 4:
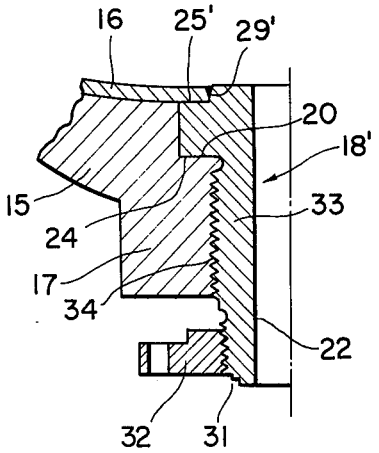
FIG. 4 is a cross sectional side view of a mounting structure according to a second embodiment of the present invention.

The second embodiment of FIG. 4 provides an improvement in this respect, in which there is provided a threaded portion 34 at a portion to be connected to the stepped portion 24 of the bulge portion 33 of the nozzle body 18' . A threading structure matable with this threaded portion 34 is formed inside the installation hole 19 in the boss portion of the pressure vessel body. Although, in the first embodiment, the collar portion 23 is formed at the leading end portion of the nozzle body to sandwich the pressure vessel body between the collar portion 23 and the nut 28, the second embodiment of FIG. 4 may be configured such that a recessed portion 25' is formed on the nozzle body for abutment against the liner 16 with the with the liner 16 overlying and covering the recessed portion 25'. In no event can the joint between the nozzle body and the pressure vessel body come loose even if the nozzle body expands due to heat, because in this embodiment the nozzle body 18' is threaded directly into the boss portion 17 of the vessel body 15. Another advantage is more complete seal relying upon welding because the front of the nozzle body is protected by the liner 16 and welding 29' is effected on that portion.

Figure 5:
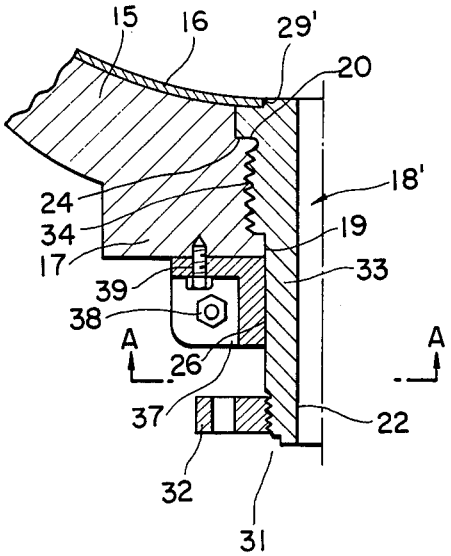
FIG. 5 is a cross sectional side view of a mounting structure according to a third embodiment of the present invention.
Figure 6:
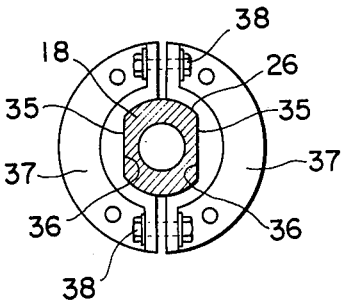
FIG. 6 is a cross sectional view taken along the line A—A in FIG. 5 when viewed along the arrows.

For the first and second embodiments wherein the nozzle body is tightly secured to the pressure vessel body by means of the threading structure, it is necessary to prevent the nozzle body from turning due to vibration of the vessel or any other reason. In this connection, the welding portions 29 and 29' are provided merely to seal the structure and neither provide substantial strength or prevent the nozzle body from turning. The third embodiment as illustrated in FIGS. 5 and 6 provides a turn-stop structure for the nozzle. These drawings suggest a modification in the nozzle mounting structure of FIG. 4, wherein the outer peripheral portion 26 of the nozzle body 18' extending outwardly of the boss portion 17 of the pressure vessel body is formed with two symmetrically disposed plane faces 35, and a pair of turn-stop members 37, 37 having plane faces 36 complementary to said plane faces of the nozzle body are secured to the nozzle body by means of bolts 38. That is, the turn-stop members 37, 37 are secured to the nozzle body 18 with the outer peripheral portion 26 of the nozzle body 18 sandwiched therebetween and held by the bolts 38 securing the member 37 to one another. The plane faces at this time the plano-configured 36 inside the turn-stop members abut against the faces 35 of the nozzle body 18' during assembling. The turn-stop members 37, 37 are also secured to the pressure vessel body by means of the bolts 39 prevent the nozzle body 18' from rotating.

Figure 7:
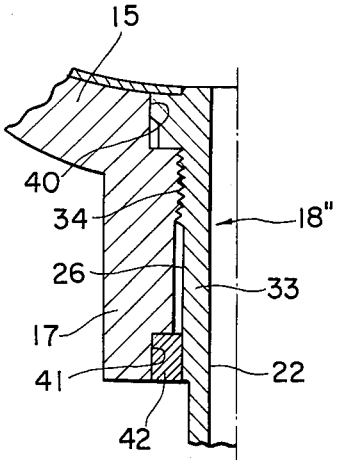
FIG. 7 is a cross sectional side view of a nozzle mounting structure according to a fourth embodiment of the present invention.

In the event that the nozzle body is secured to the pressure vessel body with play in the nozzle mounting structures according to the first, second and third embodiments, it is likely that any external force from the line or pipe leading into the nozzle body can bend the nozzle body itself and produce large stresses on the welding portion 29 or 29' between the liner 16 and the nozzle body. Close fitting of the nozzle body to the pressure vessel body is more desirable. FIG. 7 illustrates an improved nozzle mounting structure which is designed in consideration of the foregoing. The leading end portion of a nozzle body 18'' is inserted into a close fitting insertion hole 40 in the pressure vessel body 15 to ensure close fitting of the outer periphery of the leading end portion of the nozzle body in the insertion hole 40. An outlet portion of the installation hole 19 is formed coaxially with an installation hole 41 into which an annular member 42 tightly secured about the outer periphery 26 of the nozzle body 18'' is pressure-fitted to maintain the nozzle body 18'' and the pressure vessel body 15 in tight engagement and prevent lateral deflection of the nozzle body.

Figure 8:
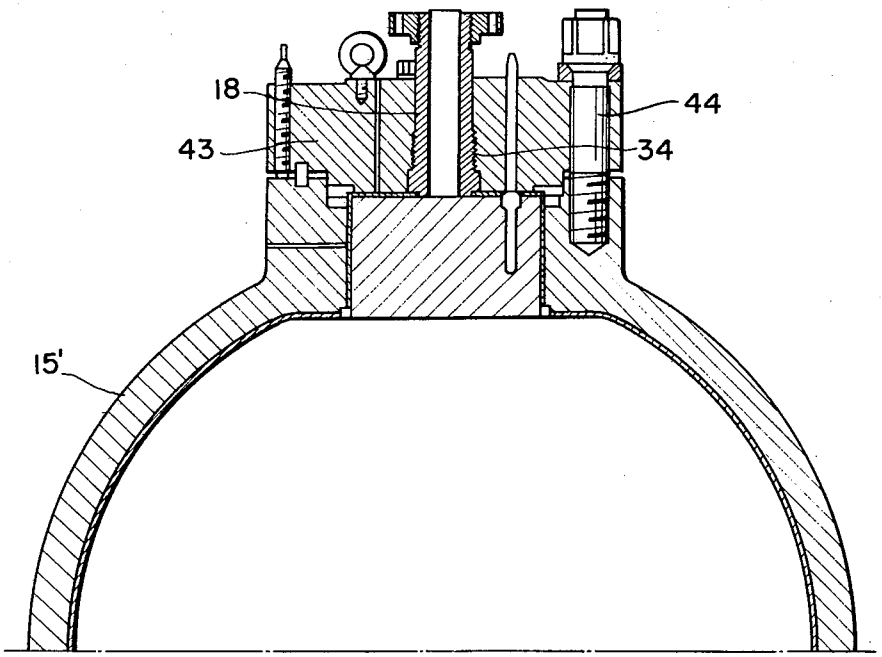
FIG. 8 is a cross sectional side view of a nozzle mounting structure according to a fifth embodiment.

Whereas in the foregoing embodiments the boss portion 17 of the pressure vessel body and the main portion thereof are formed into an integral unit, it is evident that these portions may be separate if necessary. In the fifth embodiment of FIG. 8, a lid 43 forming part of the pressure vessel body is separate from the main portion 15' of the pressure vessel body but fixedly secured to the main portion 15' by means of a bolt 44.

The above embodiments are all configured such that the nozzle body is tightly secured to the pressure vessel body by sandwiching the pressure vessel body or by means of the threaded portion disposed adjacent to the leading end of the nozzle body. When the nozzle body itself expands or contracts due to variance in operating temperature, etc. the nozzle body is free to expand or contract along its axial direction. Because of the distance between the threaded portion and the leading end surface of the nozzle body is short, there is little or no adverse effect of expansion and contraction of the nozzle body on the welding seal 29 or 29'. The mounting structures are therefore avoid the problem that a crack can appear in the welding seal 29 or that 29' or the liner on the pressure vessel side can rise due to varying temperature.

As noted earlier, the present invention is directed to a structure for mounting the cylindrical nozzle body on a pressure vessel body having an internal liner, said nozzle body being made of a material which cannot be welded to the pressure vessel body. In the mounting structure for mounting the nozzle of such special material according to the present invention the nozzle body is provided a flange or recess portion for abutment against the inner liner adhered to an inner surface of the vessel at the leading end of the nozzle directed into the pressure vessel. A stepped portion for abutment against the seating portion of the vessel body side is at its periphery behind the recessed portion. A threaded portion of the nozzle for securing the nozzle body to the vessel is at a periphery thereof reawardly of the recessed portion. Expansion or contraction of the nozzle body due to any variance of operating temperature has no impact on the nozzle-to-liner welding seal so that the lining in the neighborhood of installation of the nozzle may enjoy enhanced durability and long lifetime. The welded portion is readily detachable. It is thus very simple to exchange the nozzles when the previous one has been worn out due to erosion, corrosion and so forth since the nozzle is readily detachable by loosing the nut or bolts. In addition, since the nozzle body is of an integral configuration made of a special material, machining the joint or other portions thereof and the gasket formed at the rear end of the nozzle for joinder with the opposing flange is made simple. The advantages include savings in manufacturing cost, reduction of machining time, etc.

While the invention has been particularly shown and described with reference to preferred embodiments thereof, it will be understood by those skilled in the art that various changes may be made without departing from the spirit and scope of the invention.

What is claimed is:

1. A mounting structure for mounting a cylindrical nozzle body on a pressure vessel body having an internal lining wherein said cylindrical nozzle body is made of a material which cannot be welded to said pressure vessel body, said nozzle body comprising:

a flanged portion at a leading end positioned within said pressure vessel;

a stepped portion for abutment against a seating surface of said pressure vessel body; and a threaded portion at an end opposite said leading end for securing said nozzle body to said vessel, said stepped portion being positioned between said flanged and threaded portions.

2. A mounting structure for mounting a cylindrical nozzle body on a pressure vessel body having an internal lining wherein said cylindrical nozzle body is made of a material which cannot be welded to said pressure vessel body, said nozzle body comprising:

a recessed portion at a leading end positioned within said pressure vessel;

a stepped portion for abutment against a seating surface of said pressure vessel body; and a threaded portion at an end opposite said leading end for securing said nozzle body to said vessel, said-stepped portion being positioned between said recessed and threaded portions.

3. The mounting structure of claim 2 wherein a cylindrical periphery of said nozzle body is provided with an engaging portion engageable with a turn-stop member secured to said vessel body.

4. The mounting structure of claim 2 wherein said leading end of said nozzle body is provided with a fitting portion closely fittable in an insertion hole in said vessel body.

5. A mounting structure for mounting a nozzle body as defined in claim 2 wherein an annular member is secured about a radially outer periphery of said nozzle body, an installation hole is formed in said vessel body and said annular member is fitted in said installation hole to prevent lateral deflection of the nozzle body.

* * * * *

UNITED STATES PATENT AND TRADEMARK OFFICE

CERTIFICATE OF CORRECTION

PATENT NO. : 4,463,868

DATED : August 7, 1984

INVENTOR(S) : Noriyoshi Murase

It is certified that error appears in the above-identified patent and that said Letters Patent is hereby corrected as shown below:

In column 1, line 20, delete "the";

In column 1, line 32, set "gap" in parenthesis;

In column 2, line 9, insert --;-- after "vessel";

In column 2, line 26, change "DETAILED DESCRIPTION OF THE INVENTION" to --DETAILED DESCRIPTION OF THE PREFERRED EMBODIMENTS--;

In column 2, line 32, change "thereby" to --thereto--;

In column 2, line 49, change "bulge portion" to --main portion--;

In column 2, line 49, change "reawardly" to --rearwardly--;

In column 2, line 53, change "bulge portion" to --main portion--;

UNITED STATES PATENT AND TRADEMARK OFFICE

CERTIFICATE OF CORRECTION

PATENT NO. : 4,463,868

DATED : August 7, 1984

INVENTOR(S) : Noriyoshi Murase

It is certified that error appears in the above-identified patent and that said Letters Patent is hereby corrected as shown below:

In column 2, line 66, change "bulge portion" to --main portion--;

In column 3, line 8, change "piping" to --pipe--;

In column 3, line 21, change "bulge portion" to --main portion--;

In column 3, line 31, delete "with the" (second occurrence);

In column 3, line 60, change "nozzle body 18" to --nozzle body 18'--;

In column 3, line 61, change "nozzle body 18" to --nozzle body 18'--;

In column 3, line 62, change "member 37" to --members 37--;

In column 3, line 63, delete "at this time the plano-configured 36";

UNITED STATES PATENT AND TRADEMARK OFFICE

CERTIFICATE OF CORRECTION

PATENT NO. : 4,463,868

DATED : August 7, 1984

INVENTOR(S) : Noriyoshi Murase

It is certified that error appears in the above-identified patent and that said Letters Patent is hereby corrected as shown below:

In column 3, line 67, insert --to-- before "prevent";

In column 4, line 28, change "separate" to --separated--;

In column 4, lines 38-39, change "Because of the distance" to --Because the distance--;

In column 4, line 43, delete "are" before "therefore";

In column 4, line 44, "that" should be after "or" (second occurrence);

In column 4, line 54, insert --with-- before "a flange";

In column 4, line 54, change "recess" to --recessed--;

In column 6, line 11, delete the hyphen after "said".

Signed and Sealed this

*Eighth* Day of *October 1985*

[SEAL]

*Attest:*

DONALD J. QUIGG

*Attesting Officer*

*Commissioner of Patents and Trademarks—Designate*